US006805250B2

(12) United States Patent
Ondrasik

(10) Patent No.: US 6,805,250 B2
(45) Date of Patent: Oct. 19, 2004

(54) DIVIDER APPARATUS FOR SEPARATING PRODUCT ROWS ON SHELVES

(76) Inventor: V. John Ondrasik, 6150 Sheila St., Los Angeles, CA (US) 90040-2407

( * ) Notice: Subject to any disclaimer, the term of this patent is extended or adjusted under 35 U.S.C. 154(b) by 0 days.

(21) Appl. No.: 10/263,853

(22) Filed: Oct. 3, 2002

(65) Prior Publication Data

US 2004/0065632 A1 Apr. 8, 2004

(51) Int. Cl.[7] ..... A47F 5/00
(52) U.S. Cl. ..... 211/184; 211/90.02; 211/90.03
(58) Field of Search ..... 211/184, 90.03, 211/90.04, 90.01, 90.02, 59.2

(56) References Cited

U.S. PATENT DOCUMENTS 3,083,067 A * 3/1963 Vos et al.
3,905,484 A * 9/1975 Dean et al. ..... 211/184
4,706,821 A * 11/1987 Kohls et al.
4,889,397 A * 12/1989 Ryan ..... 312/332.1
4,901,869 A * 2/1990 Hawkinson et al.
5,111,942 A * 5/1992 Bernardin
5,265,738 A * 11/1993 Yablans et al.
5,605,237 A * 2/1997 Richardson et al.
5,839,588 A * 11/1998 Hawkinson
6,044,989 A * 4/2000 Sosso ..... 211/189
6,234,328 B1 * 5/2001 Mason ..... 211/90.02
6,389,993 B1 * 5/2002 Ondrasik ..... 211/187
6,527,129 B2 * 3/2003 Osawa ..... 211/184
2002/0179553 A1 * 12/2002 Squitieri ..... 211/59.2
2003/0010737 A1 * 1/2003 Lee ..... 211/184
2003/0132178 A1 * 7/2003 Jay et al. ..... 211/184

* cited by examiner

*Primary Examiner*—Peter M. Cuomo
*Assistant Examiner*—Erica B. Harris
(74) *Attorney, Agent, or Firm*—Gordon & Rees LLP

(57) ABSTRACT

A shelf assembly incorporates a divider apparatus for separating products on a shelf into adjacent rows. The shelf is formed from a series of spaced longitudinal wires and underlying, spaced support members extending transversely across the wires between opposite sides of the shelf. The divider apparatus has a plurality of divider panels each extending between the front and rear ends of the shelf at spaced intervals, each divider panel having an upper edge and a lower edge. The lower edge of each divider panel extends downwardly through the shelf through a gap between a selected adjacent pair of wires, and has notches to engage over the support members.

31 Claims, 3 Drawing Sheets

DIVIDER APPARATUS FOR SEPARATING PRODUCT ROWS ON SHELVES

BACKGROUND OF THE INVENTION

The present invention relates generally to shelf systems used to display and dispense products in stores such as grocery stores, and is particularly concerned with a divider apparatus for separating adjacent rows of such products on shelves as the products are fed towards the forward edge of a shelf.

Shelves supported on frames in grocery stores are sometimes tilted downwardly from the rear edge to the front edge, so that product is gravity fed from the rear to the front edge of the shelf. In this way, when a customer removes a product, such as a can of soda or a bottle containing a beverage, from the front edge, the remainder of the row of that product will slide down until another bottle or can reaches the front of the shelf. In other cases the shelves are horizontal or tilted upwards, and some type of feed mechanism is used to feed the rows of products towards the front edge of the shelf, which will have a suitable end wall for holding the product on the shelf. The products on such shelves, which are often installed in refrigerated cabinets behind glass doors, may be any type of perishable food or drink, or products that are typically sold in a refrigerated condition for immediate consumption. Thus, the shelves may support rows of individual soda cans or bottles of various sizes containing various beverages, six packs of soda cans or bottles, twelve pack boxes of such beverages, gallon bottles of milk, water, juice or the like, boxes of various foods such as pizza, and so on. Normally, it is desirable to separate adjacent rows of products with divider walls or barriers, since otherwise product in one row may interfere with product in adjacent rows as they are fed towards the front of the shelf, potentially jamming the products from proper sliding or movement to the front edge. This can reduce potential sales.

In some cases, inverted T-shaped dividers are simply placed on top of the shelf between adjacent rows. However, the base of the T can interfere with proper sliding movement of the products. Flat or planar dividers are sometimes used, and these are attached at the front and rear edge of the shelf. However, unless such dividers are made very thick, when one of the rows starts to empty, the product in an adjacent, full row can cause the divider to bend or bow into the empty row, again causing product to jam, preventing proper feeding along that row.

SUMMARY OF THE INVENTION

It is an object of the present invention to provide a new and improved divider apparatus for separating rows of products on shelves in grocery stores and the like.

According to one aspect of the present invention, a divider apparatus is provided for a shelf having a plurality of spaced longitudinal wires extending from a rear edge to a front edge of the shelf, and a plurality of support members extending transverse to the longitudinal wires and secured to the lower surfaces of the wires, which comprises a plurality of flat panels each having an upper edge and a lower edge, the lower edge of each panel having a plurality of spaced notches at predetermined positions for engaging over said support members when the panel is positioned between two adjacent wires of a shelf with the lower edge extending through the gap between the wires.

The notches may be all of the same width or of varying widths where some support members are of different dimensions to others. Some or all of the support members may have upwardly facing notches or indents into which the notches on the lower edge of the panel engage, so as to hold the divider panel in a vertical orientation. Alternatively, the wire spacing may be only slightly greater than the panel thickness, such that the wires hold the panels upright and resist bending of the panels. In this case, each panel has a shorter notch adjacent each end, which engages over a cross bar at the front and rear of the shelf which is spaced below the other cross bars or support members. This arrangement will also hold the panels upright.

According to another aspect of the present invention, a shelf assembly with dividers is provided, which comprises a rectangular shelf having an upper surface for supporting products, a lower surface, a front end, a rear end, and opposite side edges, a plurality of spaced longitudinal wires extending between the front and rear ends of the shelf, and a plurality of spaced support members extending on the lower surface of the shelf between the opposite side edges and secured to the wires at the intersections between each support member and wire, and a plurality of flat divider panels each extending between the front and rear ends of the shelf at spaced intervals to form rows of predetermined width for holding rows of products to be displayed and dispensed on the shelf, each divider panel having an upper edge and a lower edge, the lower edge having a series of notches at predetermined spacings corresponding to the spacing between said support members, and each divider member being positioned between a predetermined pair of wires on the shelf with the lower edge extending down between the wires and the notches engaging over the support members.

In one embodiment of the invention, the wires are arranged to be at a spacing only slightly greater than the thickness of a divider panel. In this way, the wires will hold the panel in an upright or vertical condition on the shelf. In one example, the dividers had a thickness of approximately 1/16 inch, while the wire spacing was approximately 1/8 inch. In an alternative embodiment, rather than spacing the shelf wires closer together, the upper edges of some or all of the support members are provided with a series of spaced notches over which the notches in the lower edges of the divider panel engage. This will also act to hold each divider panel in a vertical orientation. The close wire spacing also provides a better support surface against tipping of product supported on the shelf, and a better sliding surface for product feed.

In one embodiment of the invention, the wires at each end of the shelf are bent back under the lower surface of the shelf for strengthening purposes, and a cross bar is provided across the wire ends which will be positioned below the lower surface of the shelf. Each divider panel may be provided with a shorter notch adjacent its ends for engaging over the lower cross bar, for added stability and also to help keep the divider panel vertical. Some of the divider panel notches may be wider than others to accommodate different cross bar spacings and also so that there is no front and rear end of the divider panel such that it can be installed on the shelf in either direction. There also may be additional notches at smaller spacings for this purpose.

The divider apparatus of this invention does not interfere with proper sliding movement of the rows of products since the divider panels have no base part which must be placed on top of the shelf. Instead, the lower edge of each panel extends downwardly between the shelf wires and has notches to engage over transverse support members of the shelf. Thus, the panel is held within the body of the shelf.

The arrangement holds the divider panels vertically and avoids potential bowing or bending of a panel into a row, such that the risk of the product becoming jammed in a row is reduced.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
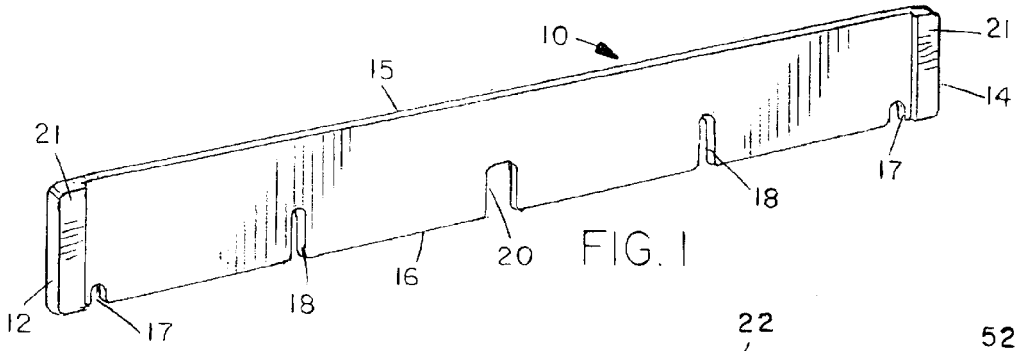
FIG. 1 is a perspective view of a divider panel according to a first embodiment of the invention.

FIGS. 1 to 5 of the drawings illustrate a shelf with a divider apparatus according to a first embodiment of the invention. The divider apparatus comprises a plurality of generally flat panels 10 of plastic, metal, or the like, each having a front end 12, a rear end 14, an upper, straight edge 15, and a lower edge 16 having a series of spaced notches, including a notch 17 adjacent each end which is shorter in height, notches 18 of a second, taller height and the same width spaced between notches 17, and one or more wider notches 20 of the same height as notches 18. In alternative arrangements, all of the notches between the end notches 17 may be of the same height and width equivalent to notches 18, depending on the shelf construction. The panel 10 may have thicker end portions 21, as indicated in FIG. 1, to help keep the panel vertical, although it may be of uniform thickness along its length in other embodiments. The thicker end portions may be formed by bending back the end edges of the panel.

FIGS. 2 to 5 illustrate the installation of a plurality of divider panels 10 on a shelf unit 22. Shelf unit 22 is generally rectangular and has a plurality of longitudinally extending, closely spaced wires 24 running from a rear edge 25 to a front edge 26 of the shelf, and a plurality of spaced cross bars or support members 28 running transversely between the opposite sides of the shelf beneath wires 24, the support members 28 being secured to wires 24 at their intersection by welding or the like. A pair of adjacent support bars 28 are welded at the center of the shelf in FIG. 2, to provide more support at this point. Double support bars 28 may be provided at other locations if necessary. A forward cross bar 32 is welded across the front edge of the shelf, and a rear cross bar 35 is welded across the rear edge of the shelf. In order to provide increased rigidity and an additional vertical support for the dividers at the front and rear edge of the shelf, short, inwardly and downwardly inclined wires or front and rear end support portions 36 are welded to the forward and rear cross bars 32,35, and cross bars 38 are secured transversely across the lower ends of the wires 36, as illustrated in more detail in FIG. 5. Cross bars 38 will be spaced below the plane of the remainder of the cross bars or support members 28. Additional cross bars 38 may be provided at other locations across the length of the shelf, if required for vertical support, for example for very long shelves requiring extra long divider panels.

Figure 7:
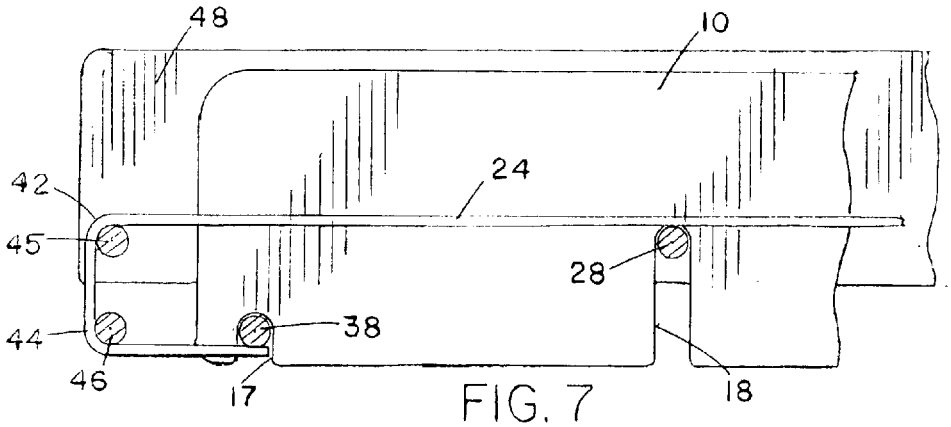
FIG. 7 is a view similar to FIG. 6, showing another front rail support.

In the alternative of FIG. 7, the wires 24 are bent into a generally rectangular, U-shaped end support portion at each end of the shelf, with a first perpendicular bend 42 directing the wire downwardly and a second perpendicular bend 44 directing the wire back inwardly beneath the shelf. Again, cross bars 38 are welded across the ends of wires 24 and will be spaced the same distance below support members 28 as in the previous arrangements. Cross bars 45 and 46 are located at the inside of each bend for added support and strength.

Figure 2:
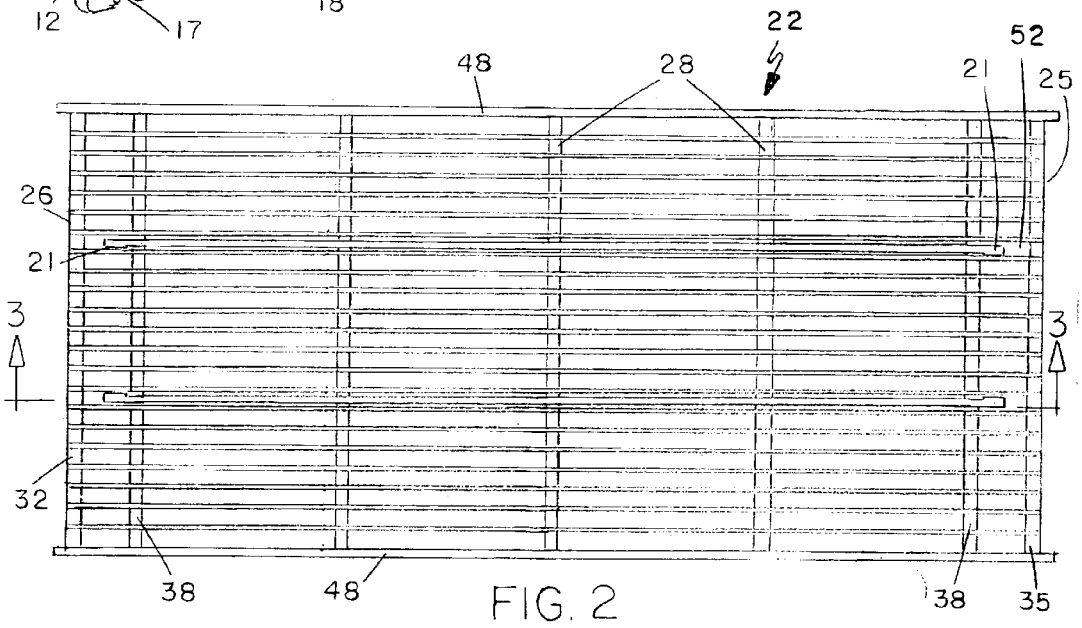
FIG. 2 is a top view of a shelf unit with two dividers installed.
Figure 3:
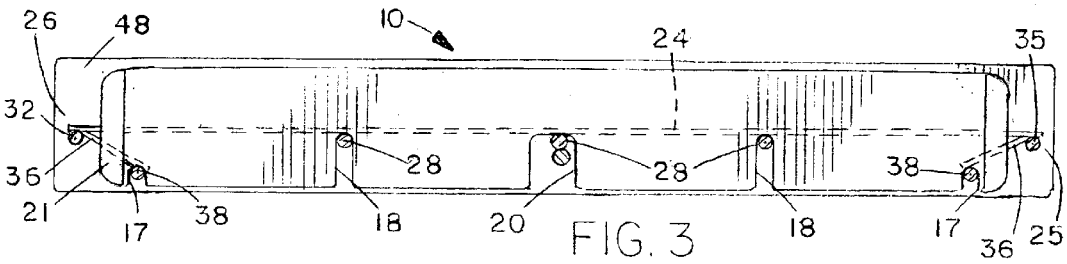
FIG. 3 is a sectional view taken on line 2—2 of FIG. 2.

A side wall 48 is welded across each side of the shelf, as indicated in FIGS. 2 and 3, to provide the outside containment for the outermost rows of products on the shelf. This also provides additional longitudinal strength to the shelf to reduce the risk of bowing of the shelf in the middle. The side walls 48 may have openings at their rear, upper corners for receiving hook members for suitably supporting the rear of the shelf to support posts of a shelving system, which typically have a series of spaced openings for receiving such hook members. This will permit variation of the shelf inclination, by moving the hook members to different post openings. It will be understood that the openings may be positioned at other locations on the side walls 48, depending on the support post positions.

A shelf may have identical spaced cross bars or support members 28 at spaced intervals along its length. However, in the embodiment illustrated in FIGS. 2 and 3, at least some of the support members may be double bars. The divider panels 10 for a shelf may have some increased width notches, such as notch 20 as illustrated in FIG. 1. This will allow for variations in the spacing between support bars. It will be understood that all of the notches may be of identical width, and that a greater or lesser number of notches may be provided, depending on the support member spacings and dimensions. Although the notches are at spacings approximately equal to the support member spacings in the illustrated embodiment, additional notches at smaller spacings may be provided. The provision of additional notches and/or smaller notch spacings will avoid having divider panels which can be installed in only one front to rear direction. Instead, the dividers will have no fixed front and rear end, and can be installed on a shelf in either direction.

Figure 5:
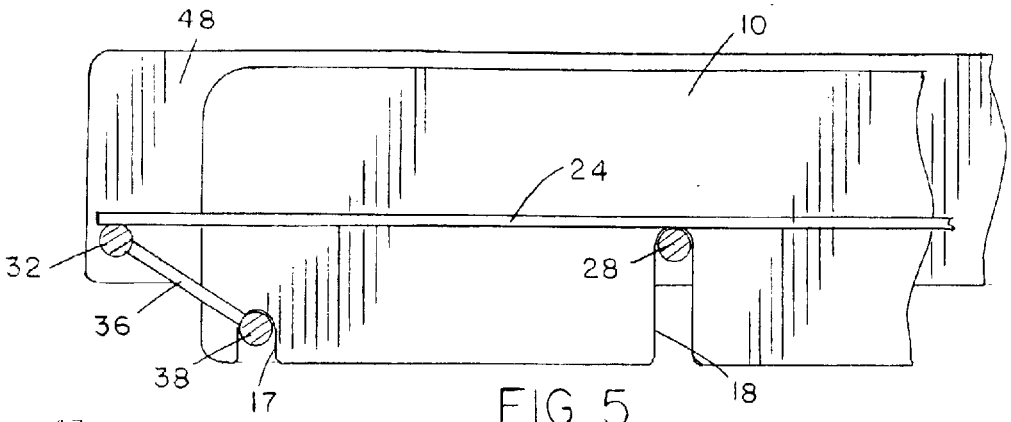
FIG. 5 is an enlarged view similar to a portion of FIG. 3, showing an alternative front alignment rail support.
Figure 6:
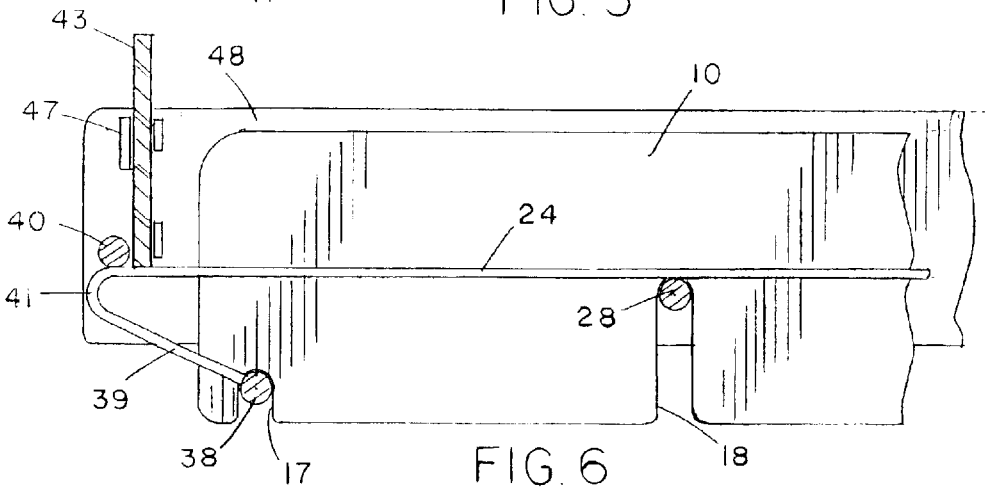
FIG. 6 is a view similar to FIG. 5, showing a further front rail support.

FIGS. 6 and 7 illustrate some alternatives to the arrangement of FIG. 5 which also provide cross bars 38 adjacent the front and rear end of the shelf which are spaced below the support members 28. FIG. 6 illustrates a simpler and less expensive arrangement, requiring less welding, in which the longitudinal wires 24 are simply bent downwardly and inwardly at an angle at each end of the shelf to form angled portions 39, and the cross bars 38 can be welded across the free ends of wires 24 themselves, prior to or after the bending procedure. Front and rear cross bars 40 are welded on top of the wires 24 at each end of the shelf, adjacent the bend 41 either before or after the wires are bent. This has an added advantage in providing support for the front side of an end stop panel 43 extending across the front end of the shelf, to hold product on the shelf. The ends of the panel 43 will be held between tabs 47 on the side walls 48. Without cross bar 40, the end stop may tend to bow out at its center unless it is made very thick. This arrangement therefor permits the end stop panel to be thinner and less expensive.

Figure 4:
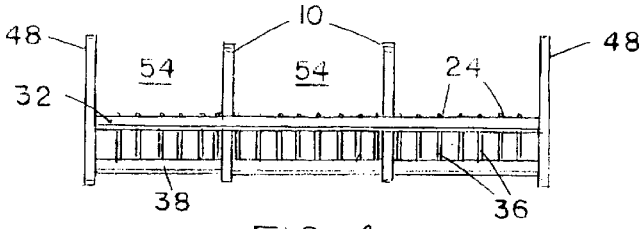
FIG. 4 is a front view of the shelf unit of FIG. 2.

A divider panel 10 is mounted on the shelf 22 quickly and easily. First, the panel is positioned above the shelf in alignment with a gap 52 between two adjacent wires 24 at the desired transverse position on the shelf, with the notches 18 aligned with respective cross bars 28. The panel is then lowered so that its lower edge moves between the wires 24, until the notches 18 and 20 engage over cross bars or support members 28, and the shorter notches 17 at the ends of the panel engage over the end cross bars 38 which are spaced below cross bars 28. The fully engaged position of the divider panel 10 on the shelf is illustrated in FIGS. 3 and 4. Divider panels 10 will be similarly positioned across the width of the shelf at selected intervals in order to form adjacent rows 54 of desired width for retaining rows of products as they are fed from the rear end 25 to the front end 26 of the shelf.

The arrangement is such that the spacing between adjacent wires 24 is slightly greater than the thickness of a divider panel 10, so that wires 24 may be more closely spaced than usual in a shelf of this type. The engagement of the notches 17,18 and 20 over the respective cross bars 38 and 28 will locate each panel and prevent movement lengthwise along the shelf, while the wires 24 on opposite sides of each panel above the cross bar engagement, and the wires 36, 39 or 44, which extend downwardly below the plane of the shelf and cross bars on opposite sides of each panel, at a spacing below the cross bar engagement, will hold the panel vertically and prevent it from bowing or bending inwardly into a row. If necessary, the end portions of the panel can be thicker, as illustrated in FIGS. 1 and 2, so as to fill more of the gap between the wires 24 and further stabilize the panel.

Figure 1A:
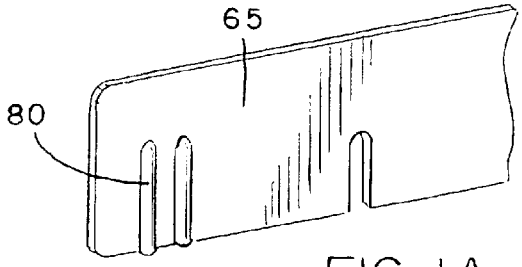
FIG. 1A illustrates a modified divider panel.

In an exemplary embodiment, the wires 24 were of ⅛ inch diameter and the gap between adjacent wires was also of the order of ⅛ inch, while the panel thickness was 1/16", apart from the thicker end portions 21. The thicker end portions had a thickness of close to ⅛ inch so that they substantially fill the gap between the wires 24. The thinner portion of the panel can only deflect 1/16", which will normally be acceptable. However, the panel can be made thicker along its entire length if this amount of deflection is a problem. The divider panel thickness may be in the range from 0.05 to 0.15 inches, while the wire spacing may be of the order of 0.10 to 0.25 inches. Instead of providing thicker deformed end portions 21, each panel may be deformed to provide vertical ribs, ridges or bumps 80 adjacent its ends, terminating just above the point where it engages wires 24, as illustrated in FIG. 1A.

Figure 8:
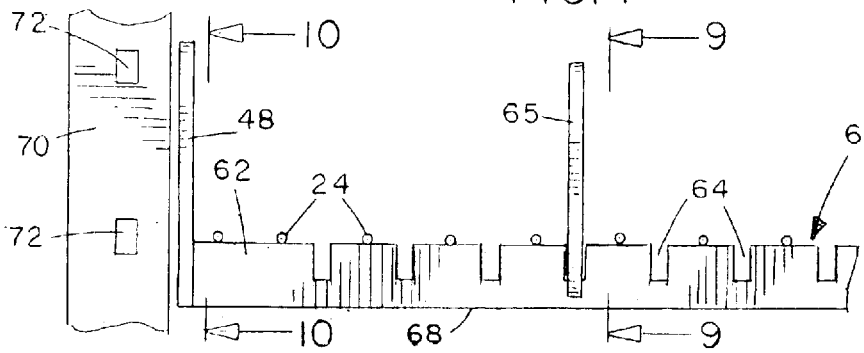
FIG. 8 is a front view of a portion of a shelf unit, showing a comb type divider support when the shelf wires are widely spaced.
Figure 9:
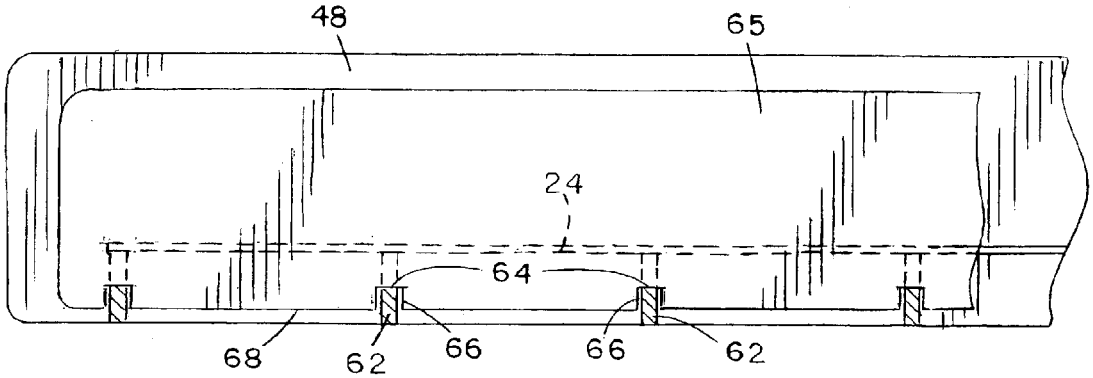
FIG. 9 is a sectional view on the lines 9—9 of FIG. 8.

FIGS. 8 and 9 illustrate an alternative where the wires 24 of a shelf 60 do not have to be positioned as close together as in the embodiment of FIGS. 1 to 5. In this embodiment, the wires 24 are spaced farther apart, but some or all of the support members 28 are replaced with cross members or braces 62 each having a plurality of spaced, upwardly facing notches 64, which will be positioned between adjacent wires 24 when the cross members 62 are secured to the lower surface of the shelf, as indicated in FIG. 8. As in the previous embodiment, a plurality of generally flat divider panels 65 are provided for releasable engagement on shelf 60. The divider panels 65 may be generally flat and do not need to have thickened end portions. A series of spaced notches 66 can be provided along the lower edge 68 of each panel. The spacing between the notches 66 is equal to the spacing between the cross members 62. However, notches 66 are not essential in all cases and panels 65 may have straight lower edges engaged in notches 64.

A plurality of divider panels 65 will be mounted on the shelf in a similar manner to the previous embodiment, except that the notches 66 on the lower edge of each panel engage in notches 64 on the support members 62. The support member notches 64 will aid in supporting the respective divider panels in an upright orientation, preventing any bending or bowing of a panel into a row. Fewer wires 24 are necessary for the shelf in this embodiment, making it potentially less expensive to manufacture.

In each of the above embodiments, the divider panels are captured in the body of the shelf, rather than resting on top of the shelf, and this avoids the problem of dividers bowing or bending into an adjacent row, potentially blocking proper feeding of products to the front of the shelf. Some alternative arrangements for capturing a divider panel are possible. For example, if the shelf is of solid construction, rather than wire grill construction, or of wire with a solid top plate, slots may be punched in the solid surface of the shelf, and the dividers may have tabs for engaging in the slots. Retention devices may be provided at the front and rear of the shelf in this case for holding the divider panels upright.

Figure 10:
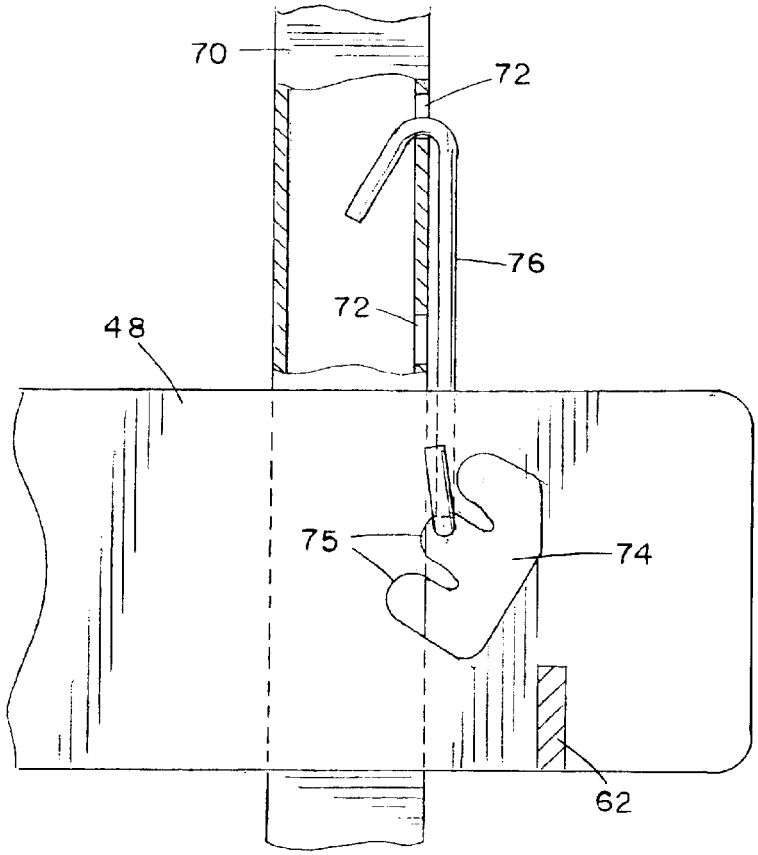
FIG. 10 is an enlarged view taken on line 10—10 of FIG. 8, showing adjustment means for the rear end of the shelf.

FIG. 10 illustrates a modified shelf side wall arrangement which permits finer adjustment of the shelf inclination. The support posts 70 of a shelf system typically have a series of equally spaced hook receiving openings 72. This means that the height of the rear end of the shelf can normally only be adjusted in increments equal to the spacing between openings 72. In the alternative illustrated in FIG. 10, the rear corner of each side wall 48 of a shelf is provided with an "E" shaped opening 74 having three indents 75 forming the limbs of the E, with the indent spacing being less than the spacing between openings 72. One end of S-hook member 76 engages an opening 72, while the other end engages a respective indent 75. In order to provide a more fine adjustment of the height of the rear end of the shelf, and thus fine adjustment of the shelf inclination angle, the hook member 76 can be moved to engage any one of the indents 75.

Although some exemplary embodiments of the invention have been described above by way of example only, it will be understood by those skilled in the field that modifications may be made to the disclosed embodiments without departing from the scope of the invention, which is defined by the appended claims.

I claim:

1. A divider apparatus for a shelf having a plurality of spaced longitudinal wires extending from a rear edge to a front edge of the shelf, and a plurality of support members extending transverse to the longitudinal wires and secured to the lower surfaces of the wires, the apparatus comprising:

a plurality of generally flat panels each having a front end, a rear end, an upper edge and a lower edge, the lower edge of each panel having a plurality of spaced notches at predetermined positions for engaging over said support members when the panel is positioned between two adjacent wires of a shelf with the lower edge extending through the gap between the wires, a notch of reduced depth being provided adjacent each end of the panel for engaging over respective cross bars extending across the front and rear end of a shelf which are spaced below the support members;

whereby said panels may be positioned at predetermined spacings across the width of a shelf to define a series of parallel rows for containing products on the shelf arranged in separate rows.

2. The apparatus as claimed in claim 1, wherein at least the majority of the notches are of a predetermined width, and at least one notch has a width greater than said predetermined width.

3. A shelf assembly for supporting products arranged in adjacent rows across the shelf, the assembly comprising:

a rectangular shelf having an upper surface for supporting products, a lower surface, a front end, a rear end, and opposite side edges;

the shelf having a plurality of spaced longitudinal wires extending between the front and rear ends of the shelf, a front support portion extending downwardly and rearwardly from each wire at the front end of the shelf, a rear support portion extending downwardly and forwardly from each wire at the rear end of the shelf, a plurality of spaced support members extending transversely across the lower surface of the shelf between the opposite side edges to form a series of intersections between each support member and the overlying wires, each support member being secured to the wires at the intersections;

a plurality of divider panels each extending between the front and rear ends of the shelf at spaced intervals to form rows of predetermined width for holding rows of products to be displayed and dispensed on the shelf, each divider panel having an upper edge and a lower edge;

the lower edge of each divider panel having a series of notches at predetermined spacings; and each divider panel being positioned between a predetermined pair of wires on the shelf with the lower edge extending down between the wires and the notches engaging over the respective support members, opposite ends of each divider panel engaging between said front and rear end support portions of said predetermined pair of wires, whereby the panels are held in a vertical orientation by said wires and front and rear end support portions.

4. The assembly as claimed in claim 3, wherein each divider panel is of predetermined thickness and the wires are positioned at a predetermined wire spacing greater than the divider panel thickness.

5. The assembly as claimed in claim 4, wherein the divider panel thickness is in the of 0.05 to 0.15 inches, and the wire spacing is in the range of 0.10 to 0.25 inches.

6. The assembly as claimed in claim 5, wherein the divider panel thickness is approximately 0.065 inches and the wire spacing is approximately 0.13 inches.

7. The assembly as claimed in claim 4, wherein the panels have end portions of a second, greater thickness than said predetermined thickness.

8. The assembly as claimed in claim 7, wherein said second thickness is approximately twice said predetermined thickness.

9. The shelf assembly as claimed in claim 5, wherein the lower edge of each divider panel has series of spaced notches of predetermined width for engaging over said support members, adjacent notches being spaced apart by a predetermined spacing, said predetermined spacing being greater than the width of said notches.

10. The shelf assembly as claimed in claim 9, wherein said notches include a plurality of notches of a first width and at least one notch of a second width greater than said first width.

11. The shelf assembly as claimed in claim 9, wherein the support members are spaced apart by a first spacing and at least some of said notches comprise a set of notches spaced apart by a spacing equal to said first spacing.

12. The shelf assembly as claimed in claim 11, wherein each divider panel has opposite first and second ends, and includes additional notches positioned between at least some of said set of notches, whereby each divider panel may be positioned on the shelf in either direction relative to the front and rear ends of the shelf.

13. A shelf assembly for supporting products arranged in adjacent rows across the shelf, the assembly comprising:

a rectangular shelf having an upper surface for supporting products, a lower surface, front end, a rear end, and opposite side edges;

the shelf having a plurality of spaced longitudinal wires extending between the front and rear ends of the shelf, the wires being spaced at a predetermined wire spacing, and a plurality of spaced support members extending transversely across the lower surface of the shelf between the opposite side edges to form a series of intersections between each support member and the overlying wires, each support member being secured to the wires at the intersections;

a plurality of divider panels of predetermined thickness each extending between the front and rear ends of the shelf at spaced intervals to form rows of predetermined width for holding rows of products to be displayed and dispensed on the shelf, each divider panel having an upper edge and a lower edge; the lower edge of each divider panel having a series of notches at predetermined spacings;

each divider panel being positioned between a predetermined pair of wires on the shelf with the lower edge extending down between the wires and the notches engaging over the respective support members; and the wire spacing being twice the divider panel thickness.

14. A shelf assembly for supporting products arranged in adjacent rows across the shelf, the assembly comprising:

a rectangular shelf having an upper surface for supporting products, a lower surface, a front end, a rear end, and opposite side edges;

the shelf having a plurality of spaced longitudinal wires extending between the front and rear ends of the shelf, and a plurality of spaced support members extending transversely across the lower surface of the shelf between the opposite side edges to form a series of intersections between each support member and the overlying wires, each support member being secured to the wires at the intersections;

a plurality of divider panels each extending between the front and rear ends of the shelf at spaced intervals to form rows of predetermined width for holding rows of products to be displayed and dispensed on the shelf, each divider panel having an upper edge and a lower edge; the lower edge of each divider panel having a series of notches at predetermined spacings;

each divider panel being positioned between a predetermined pair of wires on the shelf with the lower edge extending down between the wires and the notches engaging over the respective support members; and each support member has an upper edge, and the upper edges of the support members are provided with a series of spaced notches, at least some of the notches in the support members engaging the notches in the lower edges of the respective divider panels where the divider panels cross over said support members.

15. The assembly as claimed in claim 14, wherein the notches in the support members are of predetermined width slightly greater than the thickness of a divider panel, and comprise means for orienting the divider panels in a generally upright orientation.

16. A shelf assembly for supporting products arranged in adjacent rows across the shelf, the assembly comprising:

a rectangular shelf having an upper surface for supporting products, a lower surface, a front end, a rear end, and opposite side edges;

the shelf having a plurality of spaced longitudinal wires extending between the front and rear ends of the shelf, and a plurality of spaced support members extending transversely across the lower surface of the shelf between the opposite side edges to form a series of intersections between each support member and the overlying wires, each support member being secured to the wires at the intersections;

a plurality of divider panels each extending between the front and rear ends of the shelf at spaced intervals to form rows of predetermined width for holding rows of products to be displayed and dispensed on the shelf, each divider panel having an upper edge and a lower edge; the lower edge of each divider panel having a series of notches at predetermined spacings;

each divider panel being positioned between a predetermined pair of wires on the shelf with the lower edge extending down between the wires and the notches engaging over the respective support members; and a pair of outer side walls each secured to a respective outer side edge of the shelf, each outer side wall having a rear corner, and having an opening adjacent said rear corner for receiving a hook for suspending the rear end of the shelf from a respective rear support post.

17. The assembly as claimed in claim 16, wherein the opening has a series of indents for selectively receiving the hook end in order to adjust the height of the rear end of the shelf.

18. The assembly as claimed in claim 17, wherein the opening is generally E-shaped.

19. A shelf assembly for supporting products arranged in adjacent rows across the shelf, the assembly comprising:

a rectangular shelf having an upper surface for supporting products, a lower surface, a front end, a rear end, and opposite side edges;

the shelf having a plurality of spaced longitudinal wires extending between the front and rear ends of the shelf, and a plurality of spaced support members extending transversely across the lower surface of the shelf between the opposite side edges to form a series of intersections between each support member and the overlying wires, each support member being secured to the wires at the intersections;

a plurality of divider panels each extending between the front and rear ends of the shelf at spaced intervals to form rows of predetermined width for holding rows of products to be displayed and dispensed on the shelf, each divider panel having an upper edge and a lower edge; the lower edge of each divider panel having a series of notches at predetermined spacings;

each divider panel being positioned between a predetermined pair of wires on the shelf with the lower edge extending down between the wires and the notches engaging over the respective support members; and the shelf having a first set of support members in a first plane and a second set of support members in a second plane spaced below the first plane, each divider panel having a first set of notches for engaging over said first set of support members and a second set of notches for engaging over said second set of support members.

20. The assembly as claimed in claim 19, wherein said second set of support members comprise at least one cross bar at each end of the shelf, and each divider panel has a notch of a first, reduced height adjacent each end for engagement over said cross bars, the first set of notches having a second height greater than said first height for engaging over said first set of support members in said first plane spaced above said second plane.

21. The assembly as claimed in claim 20, wherein the shelf has a downwardly and rearwardly extending portion at its front end and a downwardly and forwardly extending portion at its rear end, and the cross bars extend across the end of each downwardly extending portion.

22. The assembly as claimed in claim 21, wherein said downwardly extending portions are formed by bending said wires downwardly and inwardly at the front and rear end of the shelf.

23. The assembly as claimed in claim 22, wherein said wires each have a bend at the front and rear end of the shelf, and a support bar extends across said wires at said bend on top of said shelf.

24. The assembly as claimed in claim 22, wherein said downwardly extending portions comprise a downwardly and rearwardly inclined portion of each wire at the front end of the shelf and a downwardly and forwardly inclined portion at the rear end of the shelf.

25. The assembly as claimed in claim 22, wherein said wires each have a first perpendicular bend directing said wire downwardly and a second perpendicular bend directing said wire inwardly under the shelf at each end of the shelf.

26. A shelf assembly for supporting products arranged in adjacent rows across the shelf, the assembly comprising:

a rectangular shelf having an upper surface for supporting products, a lower surface, a front end, a rear end, and opposite side edges;

the upper surface of the shelf having a series of spaced openings across the width of the shelf, each opening extending along at least part of the length of the shelf;

a plurality of divider panels each extending between the front and rear ends of the shelf at spaced intervals to form rows of predetermined width for holding rows of products to be displayed and dispensed on the shelf, each divider panel having an upper edge and a lower edge;

the lower edge of each divider panel extending downwardly through the shelf through at least one of said openings;

a pair of outer side walls each secured to a respective side edge of the shelf to form a row with a respective adjacent divider panel; and each outer side panel having an opening for receiving a hook for suspending the shelf from a respective support post.

27. The assembly as claimed in claim 26, wherein the opening has a series of indents for selectively receiving the hook end in order to adjust the height of the rear end of the shelf.

28. The assembly as claimed in claim 27, wherein the opening is generally E-shaped.

29. A shelf assembly for supporting products arranged in adjacent rows across the shelf, the assembly comprising:

a rectangular shelf having an upper surface for supporting products, a lower surface, a front end, a rear end, and opposite side edges;

the upper surface of the shelf having a series of spaced openings across the width of the shelf, each opening extending along at least part of the length of the a plurality of divider panels each extending between the front and rear ends of the shelf at spaced intervals to form rows of predetermined width for holding rows of products to be displayed and dispensed on the shelf, each divider panel having an upper edge and a lower edge;

the lower edge of each divider panel extending downwardly through the shelf through at least one of said openings;

the shelf having a plurality of spaced, longitudinal wires extending between the front and rear ends of the shelf, and a plurality of spaced support members extending transversely across the lower surface of the shelf between the opposite side edges, the divider panels extending downwardly between adjacent wires and engaging over said support members; and each support member having an upper surface, the upper surface having a series of spaced notches for receiving the lower edge of respective divider panels extending downwardly between adjacent wires.

30. The assembly as claimed in claim 29, including a pair of outer side walls each secured to a respective side edge of the shelf to form a row with a respective adjacent divider panel.

31. A shelf assembly for supporting products arranged in adjacent rows across the shelf, the assembly comprising:

a rectangular shelf having an upper surface for supporting products, a lower surface, a front end, a rear end, and opposite side edges;

the shelf having a plurality of spaced longitudinal wires extending between the front and rear ends of the shelf, a plurality of spaced support members extending transversely across the lower surface of the shelf between the opposite side edges to form a series of intersections between each support member and the overlying wires, each support member being secured to the wires at the intersections, and each wire having at least one lower support portion extending downwardly from the wire and below the support members;

the lower edge of each divider panel having a series of notches at predetermined spacings; and each divider panel being positioned between a predetermined pair of wires on the shelf with the lower edge extending down between the wires and the notches engaging over the respective support members, and being held between the lower support portions at a location spaced below the support members, whereby the panels are held in a vertical orientation by engagement of said panels between said wires and between said lower support members at a location spaced below said wires.

* * * * *